United States Patent [19]

Kaneko

[11] Patent Number: 4,655,329

[45] Date of Patent: Apr. 7, 1987

[54] COLLAPSIBLE LUGGAGE

[75] Inventor: Katsuyoshi Kaneko, Tokyo, Japan

[73] Assignee: Maruwa Echo Co. Ltd., Tokyo, Japan

[21] Appl. No.: 780,955

[22] Filed: Sep. 27, 1985

[30] Foreign Application Priority Data

Dec. 13, 1984 [JP] Japan ..... 59-188119[U]

[51] Int. Cl.[4] ..... A45C 7/00; A45C 13/04

[52] U.S. Cl. ..... 190/107; 190/127

[58] Field of Search ..... 190/103, 107, 127, 110, 190/100, 109, 24, 25; 229/41 R

[56] References Cited

U.S. PATENT DOCUMENTS

| | | | |
|---|---|---|---|
| 1,273,875 | 7/1918 | Kosta | 190/103 X |
| 1,387,597 | 8/1921 | Fetters | 190/107 |
| 1,636,838 | 7/1927 | Roser | 190/103 |
| 2,538,616 | 1/1951 | Cross | 190/107 |
| 2,774,450 | 12/1956 | Smallberg | 190/127 |
| 4,210,230 | 7/1980 | Weiner | 190/107 |
| 4,350,194 | 9/1982 | Brown | 190/110 X |

FOREIGN PATENT DOCUMENTS

| | | | |
|---|---|---|---|
| 1191799 | 4/1959 | France | 190/107 |
| 1315104 | 12/1962 | France | 190/107 |
| 727879 | 4/1955 | United Kingdom | 190/107 |

*Primary Examiner*—William Price
*Assistant Examiner*—Sue A. Weaver
*Attorney, Agent, or Firm*—Fleit, Jacobson, Cohn & Price

[57] ABSTRACT

The present invention relates to luggage which includes a ceiling board having a handle, a bottom board, front and rear faces and both side walls which are composed of freely foldable sheets. The bag portions are formed in the inner lower parts of both side walls at both right and left sides, and fastening tools are attached to both corners of the ceiling part respectively, and further hard side reinforced inserts having core materials inside are composed to be attached to the pockets and the fastener tools attachably or freely removably.

2 Claims, 5 Drawing Figures

COLLAPSIBLE LUGGAGE

FIELD OF THE INVENTION

The present invention relates to luggage which is capable of being used in overseas travel and more particularly relates to a luggage which is capable of folding up to a small size by simple handling.

BACKGROUND OF THE INVENTION

In order to store luggage prior to customary usage, when the luggage is kept in a storehouse, transported, or kept in a closet by a purchaser, a storage space is required. A carriage, a storage space and the like for the luggage are uneconomical as well as inconvenient.

SUMMARY OF THE INVENTION

Luggage in accordance with the present invention avoids these customary defects and are improved fundamentally, as shown in FIG. 1 especially, packets 11 are formed respectively at the lower parts of both side walls 8 which are arranged on right and left sides in the inside of the luggage 1, and hard side reinforcing inserts 9 whose insides are reinforced by core materials, and secondly at the time of assembling and composing the luggage 1, as shown in FIG. 2 and FIG. 3, the lower parts of the side reinforcing inserts 9 are inserted in the pockets 11 as well as the upper ends of the side reinforcing inserts 9 are fixed on both side walls 8 by another fastening means 10 and then the luggage 1 is assembled and composed by reinforcing both side walls 8, and further at the time of folding up the luggage 1 into a flat configuration, the lower parts of side reinforcing inserts 9 are pulled out from the pockets 11 of the side walls 8, the side reinforcing inserts 9 are folded back on the bottom cover 4 of the luggage 1 as shown in FIG. 4 and both side walls 8 are bent, and then the present invention relates to a luggage 1 which is capable of folding up the whole body to small size as shown in FIG. 5.

DETAILED DESCRIPTION OF THE INVENTION

Figure 1:
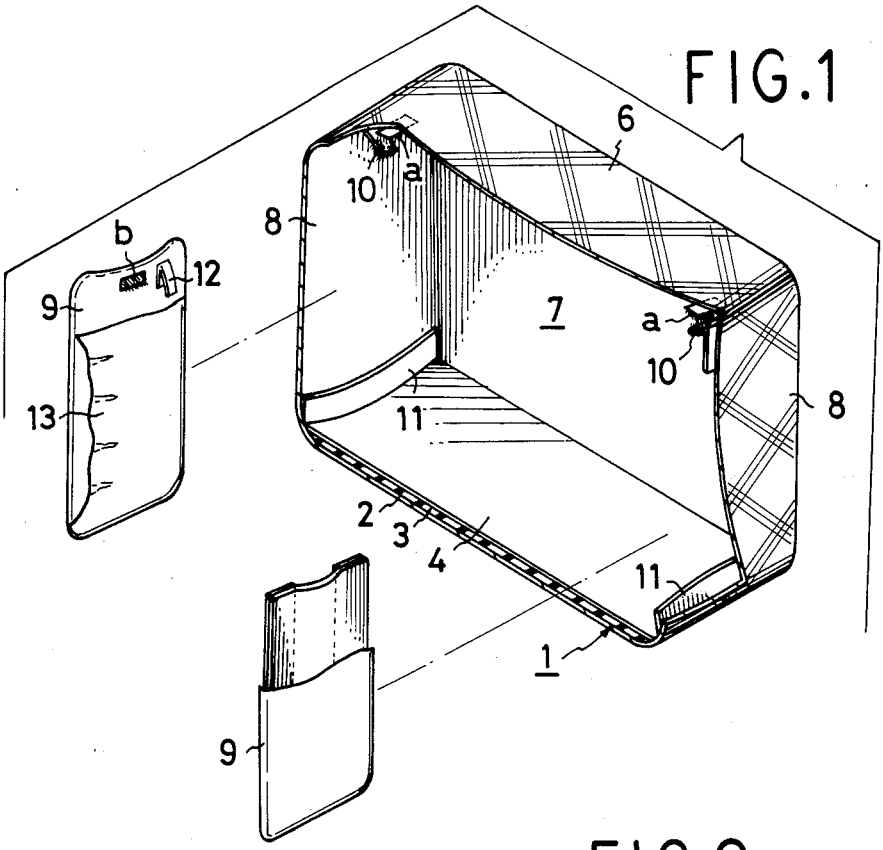
FIG. 1 is a perspective explanatory view illustrating component parts of the luggage in accordance with the present invention.

Referring now to the composing parts of the luggage in accordance with the present invention in detail, in FIG. 1, a large piece of luggage 1 is comprised of a bottom board 2, a ceiling board 6, freely bent side walls 8 composed of soft sheet which are arranged at both right and left sides, and freely bent-front and rear faces 7 composed of soft sheet which are arranged at front and rear portions of the luggage 1. A reinforcing board 3 and a bottom cover 4 which is capable of covering the reinforcing board 3 are laminated in order on said bottom board 2. Both corner parts of the luggage 1 are provided with pockets 11 located alongside of the side walls 8. Reference numeral 9 are two side reinforcing inserts which are formed aside from the luggage 1 and the side reinforcing inserts are able to stand up along the inside of said side walls 8 and the lower parts of these side reinforcing inserts 9 are composed to be able to insert in said pockets 11. The upper central parts of these side reinforcing inserts 9 are formed with concave shape, and the upper side faces of the reinforcing inserts 9 are provided with hook and loop fasteners b and knobs 12, and further a pouch 13 which is capable of receiving small articles is formed for one side of the side reinforcing inserts 9.

Both corners of the ceiling part of the luggage 1 are provided projectively with fastening means 10 bent-adjustably, said fastening means is capable of holding the upper end part of the side reinforcing insert 9, and further the ceiling parts near the fastening means 10 are provided with hook and loop fasteners a which are capable of holding these fastening means 10 temporarily.

Figure 2:
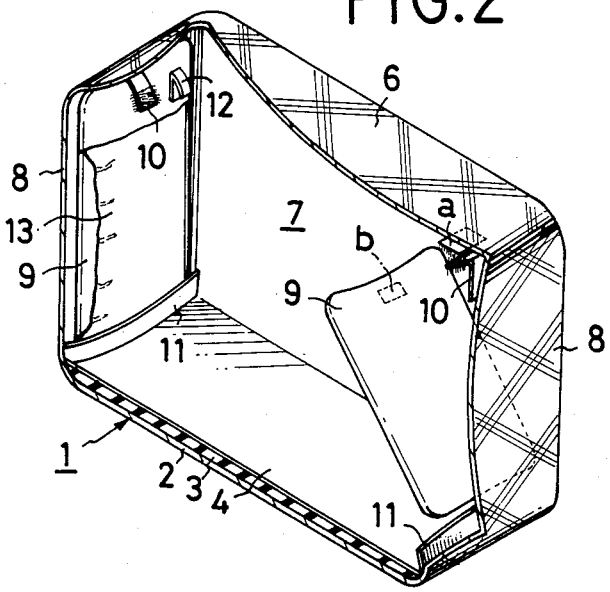
FIG. 2 is a perspective explanatory view where the inside is disclosed, illustrating the assembling state of the luggage as shown in FIG. 1.
Figure 3:
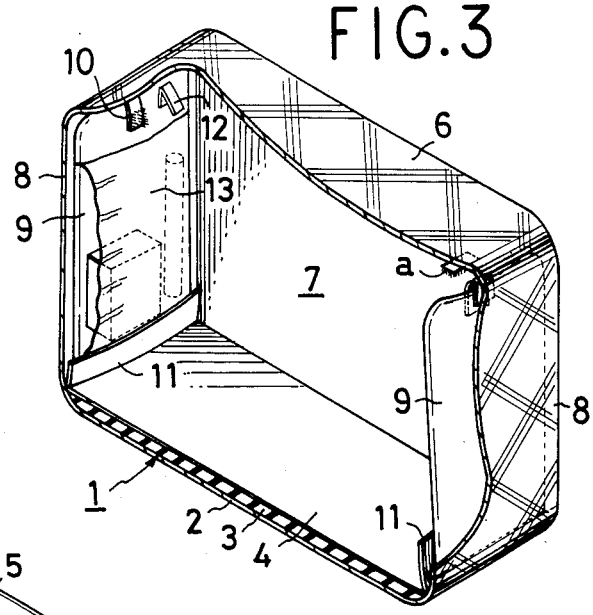
FIG. 3 is an explanatory view illustrating the assembling state where the state shown in FIG. 2 is further advanced.

At the time of assembling and composing the luggage 1 in accordance with the present invention as shown in FIG. 2 and FIG. 3, after the lower parts of the side reinforcing inserts 9 are inserted in the pockets 11 which are arranged to the side walls 8 of the luggage 1, these side reinforcing inserts 9 are stood up along the insides of the side walls 8, the fastening means 10 which are arranged at the corners of the ceiling part of the luggage 1 adhere to the hook and loop fasteners b, and then the side reinforcing inserts 9 are fixed within the luggage 1, and consequently the whole body of the luggage can be assembled and composed. Therefore the luggage can be used in this state.

Figure 5:
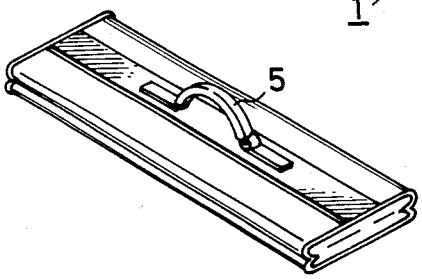
FIG. 5 is a perspective explanatory view illustrating the state which the whole body of the luggage is folded up flat.
Figure 4:
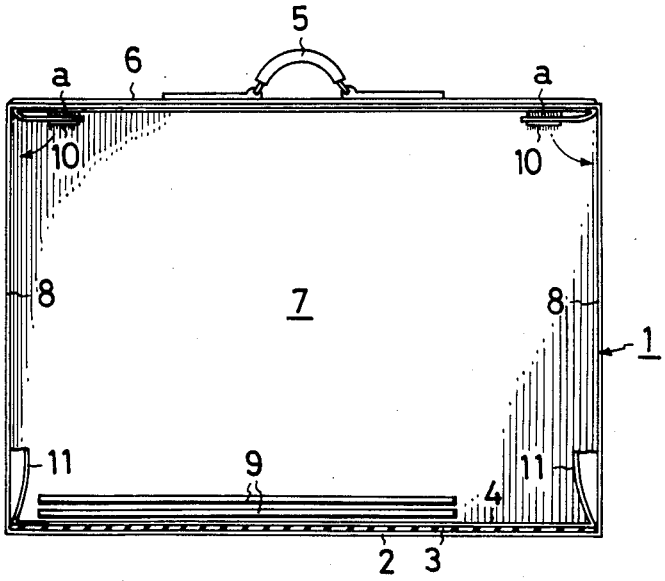
FIG. 4 is a vertical sectional explanatory view of the state where the reinforcing side reinforcing inserts standing up in the inside of right and left sides are brought down on the bottom face in order to fold up the whole body of the luggage.

Secondly, at the time of folding up the luggage 1 to a small size, as shown in FIG. 4, the fastening means 10 which are arranged at the corners of the ceiling part of the luggage 1 are pulled apart from the hook and loop fasteners b of the side reinforcing inserts 9, and now these fastening means 10 are attached toward the hook and loop fasteners a of the ceiling part of the luggage 1, and subsequently the side reinforcing inserts 9 are brought down in the inside of the luggage 1 by the knobs 12 brought, and the side reinforcing inserts 9 are folded back on the upper part of the bottom board 2, and further the luggage 1 is folded up to a small size by folding up the side walls 8 of right and left sides and the front and rear faces 7 of the luggage 1 by turns respectively, and then the whole body of the luggage 1 can be folded up flatly as shown in FIG. 5. Reference numeral 5 is a handle of the luggage 1 in the drawing of FIG. 5.

As mentioned above, the luggage in accordance with the present invention has the following characteristics wherein the firm and durable side reinforcing inserts may be attached to both side walls or removed from both side walls as occasion demands. The whole body of the luggage can be stood up and formed simply by attaching these side reinforcing inserts or can be folded up flatly in a small way by bringing down these side reinforcing inserts. Storage space is not required for keeping, exhibition, transport and the like of the luggage. The handling of the luggage is economical. The lower parts of the side reinforcing inserts are inserted in the pockets which are formed in the lower parts of both side walls respectively, making attachment of the side reinforcing inserts simple. The whole body of the luggage can be retained very stably, and the structure of said whole body is simple making the manufacture of the luggage easy. Further, a method for mass-producing the luggage at low price is possible.

What is claimed is:

1. Luggage comprising:

a ceiling board having a handle, a bottom board, two flexible side faces, each side face interconnecting said ceiling board and said bottom board, a front face, a rear face, a pocket defined at a lowermost portion of each of said two side faces, two reinforcing inserts adapted to have one end fit within one of said pockets, first fastening means pivotally mounted adjacent both intersections of said two side faces and said ceiling board, second fastening means located at an end of each of said two reinforcing inserts opposite to said one end adapted to fit within said pockets, third fastening means located at both ends of said ceiling board adjacent to said first fastening means, said first fastening means being positionable in two positions, a first position engaged with said third fastening means for use in securing said first fastening means out of the way when folding up of said luggage, and a second position engaged with said second fastening means when said one end of said inserts are located in said pockets for removably mounting said inserts along said two side faces to form said luggage into an operative shape.

2. Luggage as claimed in claim 1, wherein a knob is located on an upper part of each insert.

* * * * *